US009994384B2

(12) United States Patent
Glass

(10) Patent No.: US 9,994,384 B2
(45) Date of Patent: Jun. 12, 2018

(54) OVOID CONTAINER FOR HOLDING A TRANSACTION CARD

(71) Applicant: Gift Card Impressions, LLC, Kansas City, MO (US)

(72) Inventor: Brett R. Glass, Kansas City, MO (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days. days.

(21) Appl. No.: 15/216,554

(22) Filed: Jul. 21, 2016

(65) Prior Publication Data

US 2016/0325914 A1 Nov. 10, 2016

Related U.S. Application Data

(63) Continuation-in-part of application No. 14/081,819, filed on Nov. 15, 2013, now abandoned.

(60) Provisional application No. 61/727,613, filed on Nov. 16, 2012.

(51) Int. Cl.

| | |
|---|---|
| ***B65D 81/36*** | (2006.01) |
| ***B65D 77/04*** | (2006.01) |
| ***B65D 8/00*** | (2006.01) |
| ***A45C 11/18*** | (2006.01) |
| ***B65D 75/36*** | (2006.01) |
| ***B65D 5/42*** | (2006.01) |
| *B65D 33/16* | (2006.01) |

(52) U.S. Cl.

CPC ..... *B65D 81/365* (2013.01); *A45C 11/182* (2013.01); *B65D 5/4204* (2013.01); *B65D 5/4225* (2013.01); *B65D 11/02* (2013.01); *B65D 75/367* (2013.01); *B65D 77/04* (2013.01); *B65D 33/16* (2013.01)

(58) Field of Classification Search

CPC .... B65D 75/28; B65D 11/188; B65D 11/105; B65D 11/10; B65D 11/18; B65D 81/365; B65D 11/02; A45C 11/185; A45C 11/18; A45C 11/182

USPC ..... 206/457; 220/4.21, 4.22, 4.24, 4.25

See application file for complete search history.

(56) References Cited

U.S. PATENT DOCUMENTS

| | | | | |
|---|---|---|---|---|
| 2,341,092 A * | 2/1944 | Gooden | A24F 19/00 | 131/242 |
| 2,998,896 A * | 9/1961 | Miller | B65D 11/02 | 220/4.26 |
| 4,124,135 A * | 11/1978 | Weder | B65D 81/365 | 220/4.21 |
| 5,209,345 A * | 5/1993 | Haugabook | G09B 19/00 | 206/1.5 |
| 5,287,979 A * | 2/1994 | Bourgeois | A47G 19/28 | 206/509 |
| 5,925,391 A * | 7/1999 | Whetstone, Jr. | A23G 1/505 | 426/104 |
| 6,544,097 B1 * | 4/2003 | Bain | A63H 3/28 | 446/297 |
| 6,832,797 B1 * | 12/2004 | Gassel | A47F 7/0028 | 211/70.6 |

(Continued)

*Primary Examiner* — Steven A. Reynolds
(74) *Attorney, Agent, or Firm* — Erise IP, P.A.

(57) ABSTRACT

An ovoid container for holding one or more transaction cards, such as gift cards, that includes a distinctive size and shape to attract attention. The ovoid container is dimensioned to receive and securely hold a transaction card. The exterior surface of the container is a distinctive color, such as gold, to identify the container as a coveted prize at an Easter egg hunt or other game.

9 Claims, 14 Drawing Sheets

(56) References Cited

U.S. PATENT DOCUMENTS

| | | | | |
|---|---|---|---|---|
| 7,871,651 | B2 * | 1/2011 | Sinichko | A23G 1/505<br>220/4.01 |
| 7,931,149 | B2 * | 4/2011 | Gilad | A61B 1/00144<br>206/477 |
| 2007/0108092 | A1 * | 5/2007 | Minuto | B65D 11/02<br>206/581 |
| 2012/0074029 | A1 * | 3/2012 | Lantinen | B65D 65/466<br>206/524.7 |
| 2012/0152768 | A1 * | 6/2012 | Cheema | B65D 5/48014<br>206/216 |

* cited by examiner

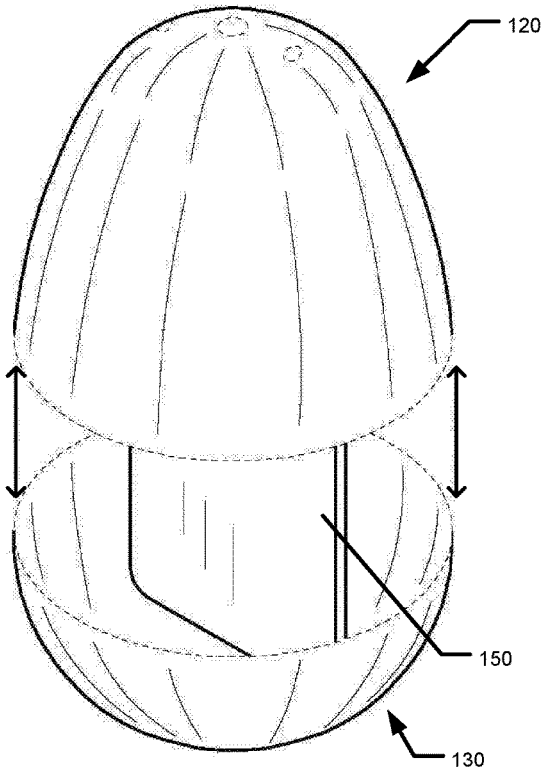
Fig. 10
Fig. 11A
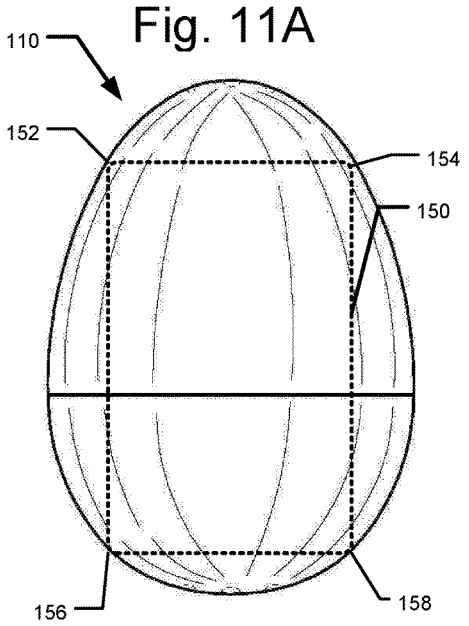
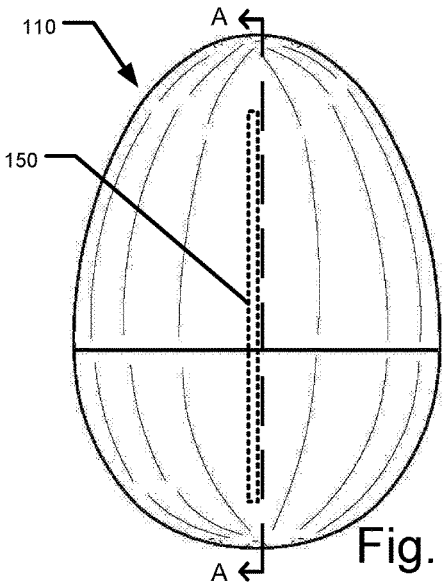
Fig. 11B
Fig. 12
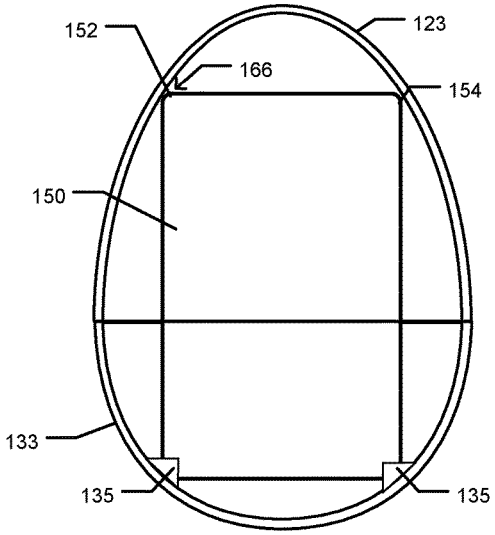

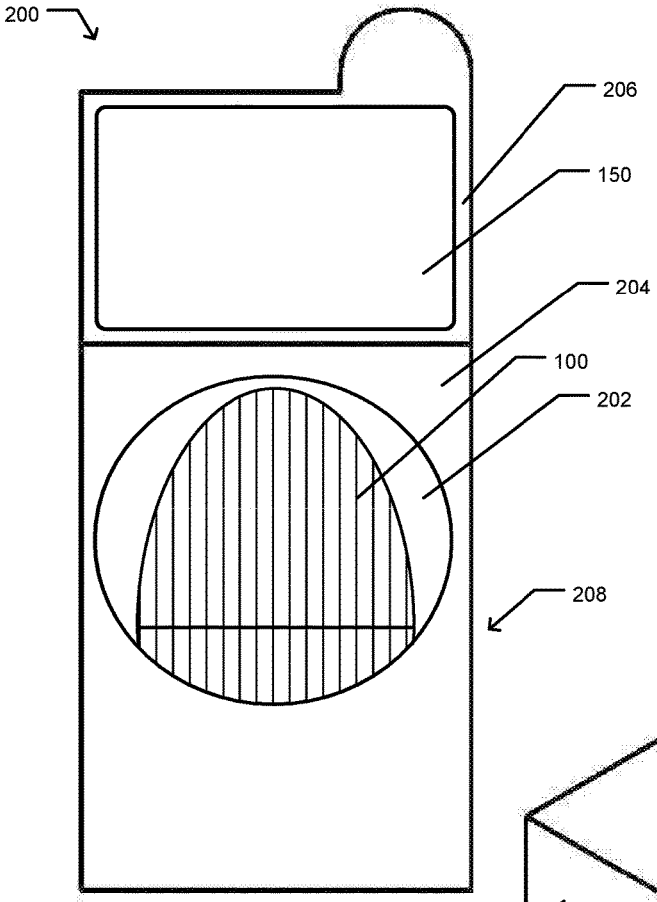
Fig. 13
Fig. 14
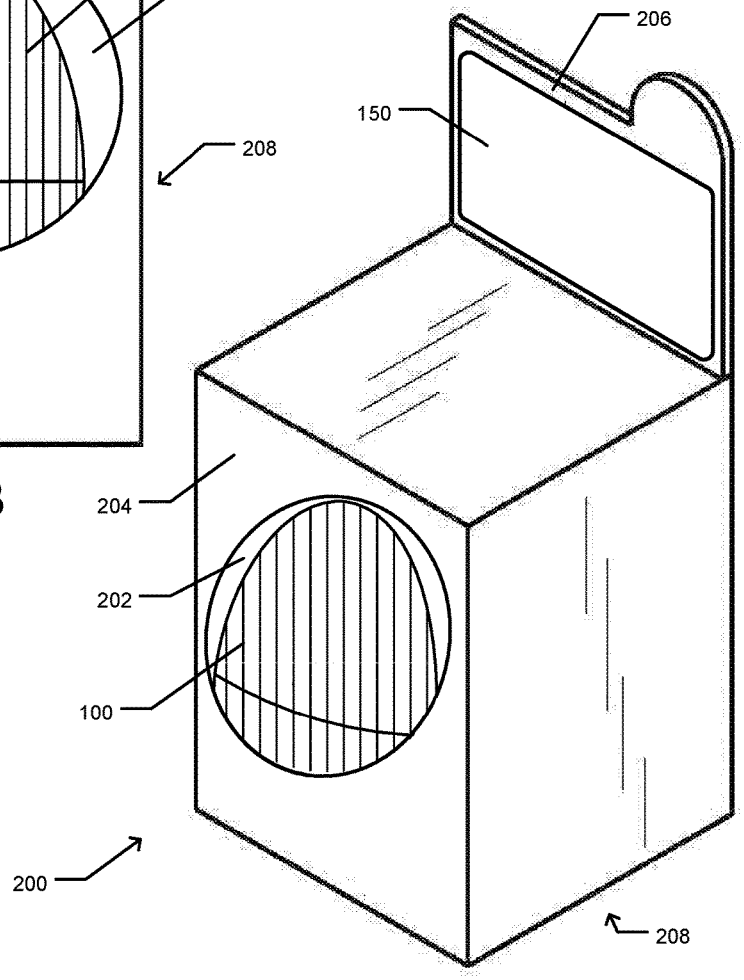

Fig. 19
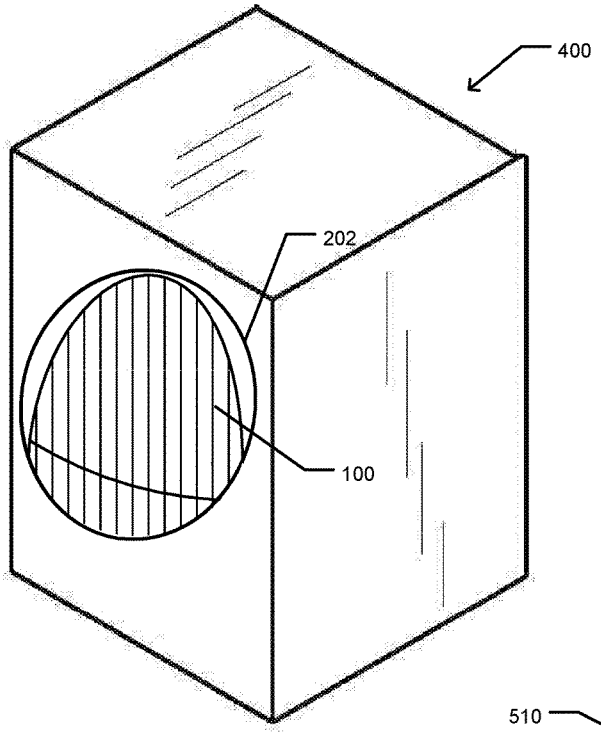
Fig. 20
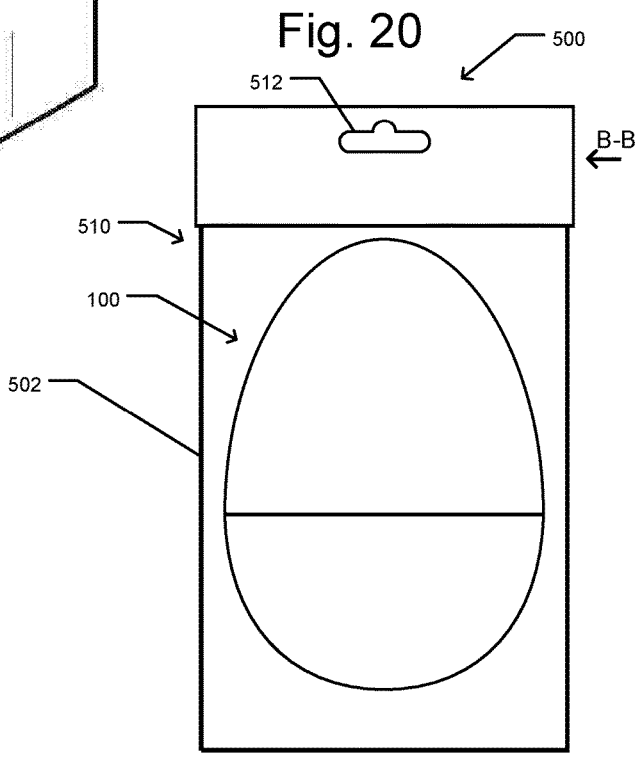
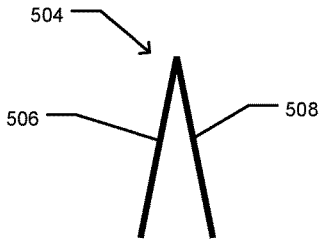
Fig. 21

OVOID CONTAINER FOR HOLDING A TRANSACTION CARD

CROSS-REFERENCE TO RELATED APPLICATIONS

This application is a continuation-in-part of U.S. patent application Ser. No. 14/081,819, entitled "An Ovoid Container For Holding A Transaction Card" filed on Nov. 15, 2013, which claims priority to U.S. Provisional Patent Application No. 61/727,613 entitled "Egg-Shaped Container For Holding A Gift Card" filed on Nov. 16, 2012, each of which is incorporated by reference herein in their entireties.

FIELD AND BACKGROUND

This disclosure relates generally to transaction card holders and more particularly to an ovoid device for holding a transaction card, such as a gift card, that is well suited for presentation during a relevant holiday or occasion.

Transaction cards, stored value cards, or gift cards, as they are commonly called based upon their intended use, have become popular gifts. Typically, gift cards are a stored value card whereby a cash equivalent value is associated with a code or other data stored upon a machine readable portion of the card, such as magnetic strip. In one aspect, the cash equivalent value may be determined by the vendor prior to packaging and display for sale; while in another aspect, the cash equivalent value is determined at the point of sale by the purchaser and associated with the purchased card. While popular, gift cards are typically provided with a generic and impersonal design, typically identifying the associated merchant for which the card may be used to purchase merchandise and, therefore, may not be perceived as special or coveted by a recipient.

Moreover, holidays and other events may be occasions for gift giving, games, and entertainment. For example, when celebrating the holiday of Easter, Easter egg hunts are common. Although gift cards have become common gift items, they have not been readily incorporated into an Easter egg hunt or placed within eggs used during the hunt, as these eggs are commonly too small to hold a standard-sized gift card within. In addition, due to the relatively high value of a gift card relative to other items that might be placed into an Easter egg for use in an Easter egg hunt, it would be advantageous if a plastic egg specially designed to hold a gift card could also be visually distinctive and more prominent to readily identify it as a desirable or coveted prize in the hunt or game.

Therefore, a need exists for a gift card container or holder designed to appear as a traditional Easter egg container yet suitable to hold a gift card within and to visually identify the container as a coveted prize.

SUMMARY

The purpose of this invention is to provide an egg-shaped or ovoid card container or holder for holding a transaction card, such as a gift card. An ovoid card container or holder may include an elongated top portion and a relatively shorter bottom portion cooperating when fitted to one another to close the container and to form together a hollow, generally ovoid-shaped main body. The top portion and bottom portion each comprise a curved, generally parabolic, and relatively thin wall defining a circular opening. The opening of the bottom portion comprises a male coupling including a flange of reduced diameter relative to the proximate wall of the bottom portion. The opening of the top portion comprises a female coupling including a flange contiguous with and of a slightly larger diameter than the proximate wall of the top portion. It should be appreciated that while not typical the top portion may include the male coupling and the bottom portion may include the female coupling. The outer surfaces of the main body include a distinctive coloration, such as a metallic gold, to render the ovoid card container more noticeable and to increase the perception of value to the observer.

In one embodiment, a transaction card holder assembly includes an ovoid main body that further includes a first portion and a second portion. The first portion has a sidewall and an opening while the second portion also has a sidewall and an opening. The first portion is removably engaged to the second portion to form an interior chamber that has dimensions suitable to receive and retain a transaction card therein. The exterior surface of the ovoid body is also golden in color.

Other advantages of the invention will become apparent from the following description taken in connection with the accompanying drawings, wherein is set forth by way of illustration and example an embodiment of the present invention.

BRIEF DESCRIPTION OF THE DRAWINGS

FIG. 10 is a perspective view of an ovoid card container showing the top portion separated from the bottom portion to reveal a transaction card disposed within the container according to one embodiment.

FIGS. 11A and 11B are elevation diagrams showing a front surface and a side edge, respectively, of a transaction card disposed within an ovoid card container according to one embodiment.

FIG. 12 is cross-sectional view of a the ovoid card container with a transaction card disposed therein as viewed along line A-A of FIG. 11B, according to one embodiment.

FIG. 13 is elevation view of an ovoid card container disposed within packaging having a transparent window in a front panel thereof according to one embodiment.

FIG. 14 is a perspective view of the ovoid card container and packaging of FIG. 13 according to one embodiment.

FIG. 19 is a perspective view of an ovoid card container disposed within packaging having a transparent window in a front panel thereof according to one embodiment.

FIG. 20 is an elevation view of an ovoid card container disposed within clear polybag packaging having a folded cardstock header according to one embodiment.

FIG. 21 is an end view of the folded cardstock header of FIG. 20 as view along line B-B, according to one embodiment.

DETAILED DESCRIPTION

The present disclosure generally relates to an ovoid shaped container specifically sized and configured to a transaction card, also referred to herein as a gift card. In one embodiment, the ovoid container is suited to hold a transaction card that is a prize for a game, puzzle, or scavenger hunt, including an Easter egg hunt. As such, the ovoid container can hold the transaction card securely once placed therein.

Figure 1:
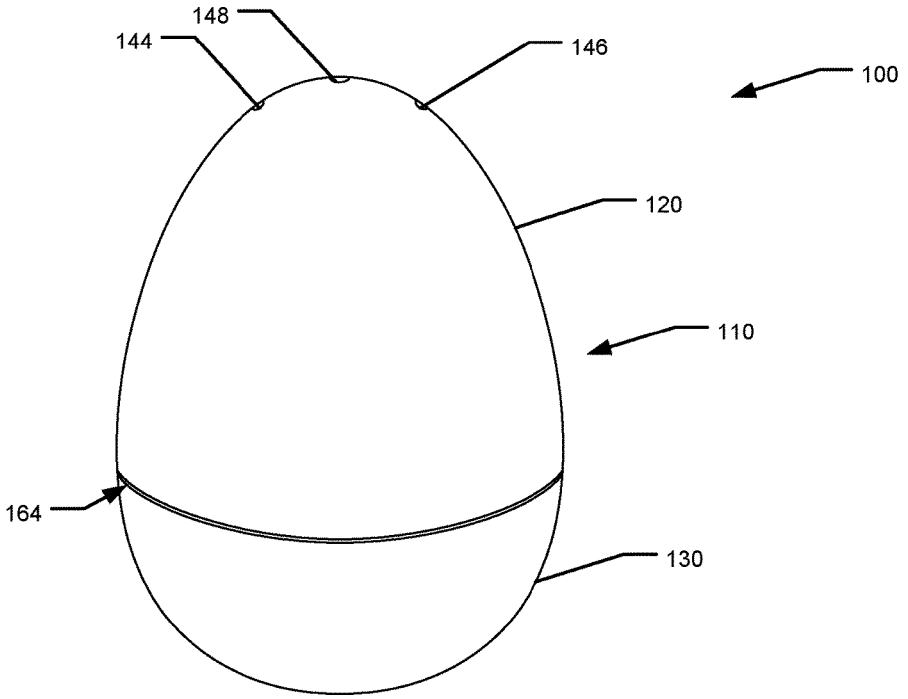
FIG. 1 is a perspective view of an ovoid card container according to one embodiment.
Figure 2:
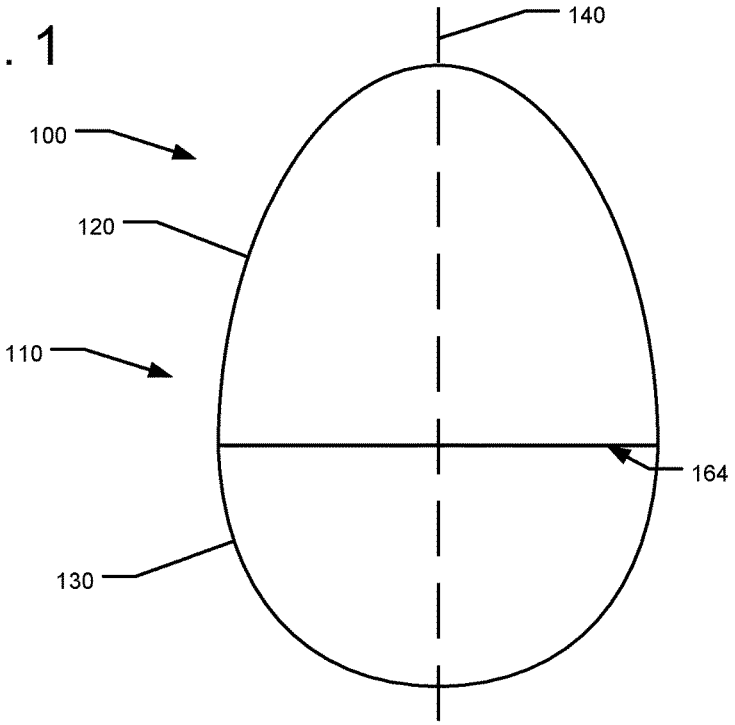
FIG. 2 is an elevation view of the ovoid card container of FIG. 1 according to one embodiment.
Figure 5:
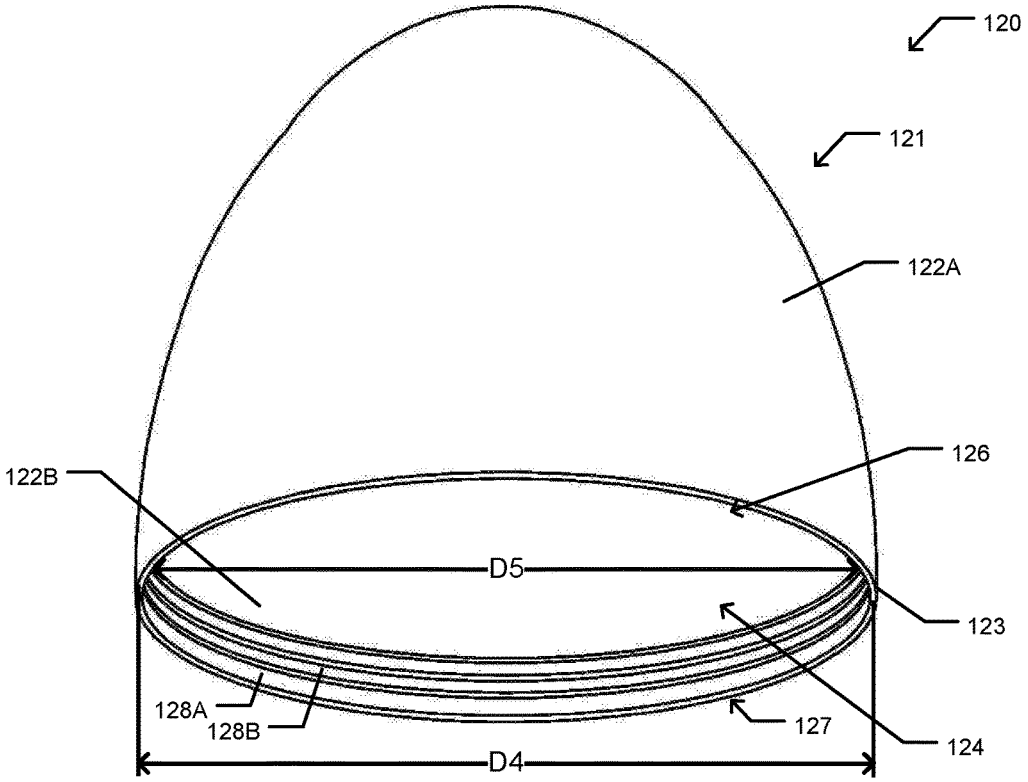
FIG. 5 is a perspective view of the top portion of an ovoid card container according to one embodiment.
Figure 6:
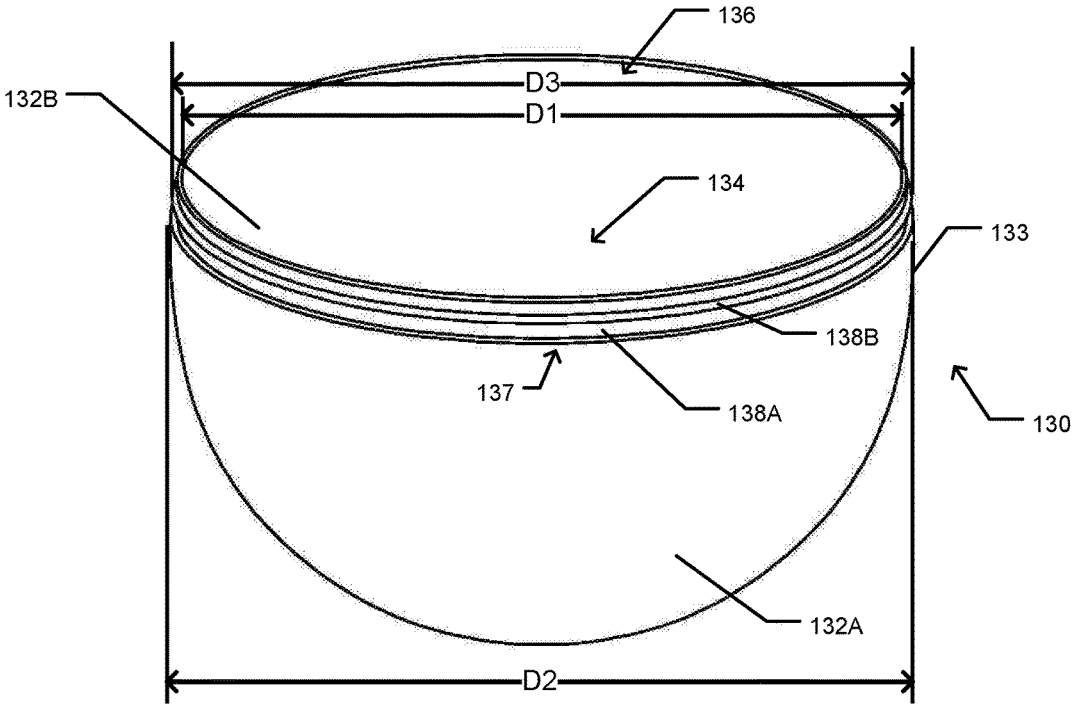
FIG. 6 is a perspective view of the bottom portion of an ovoid card container according to one embodiment.
Figure 7:
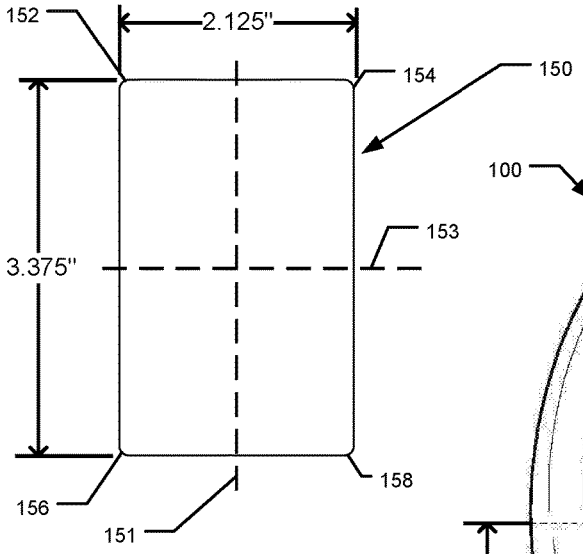
FIG. 7 is an elevation view of an example transaction card with exemplary dimensions according to one embodiment.

FIGS. 1-12 are illustrations of one or more embodiments of an ovoid transaction card container or holder 100 for holding a transaction card, such as a gift card 150 shown in FIG. 7. A perspective view and an elevation view of the ovoid card container 100 are shown in FIGS. 1-2, respectively. In one embodiment, the ovoid card container 100 includes a main body 110 that is formed from an elongated top portion 120 and a bottom portion 130 that are removably engaged to one another. As shown, the ovoid card container 100 is substantially symmetrical about a central longitudinal axis 140 and does not possess distinct front, rear or side surfaces about the axis 140.

Figure 3:
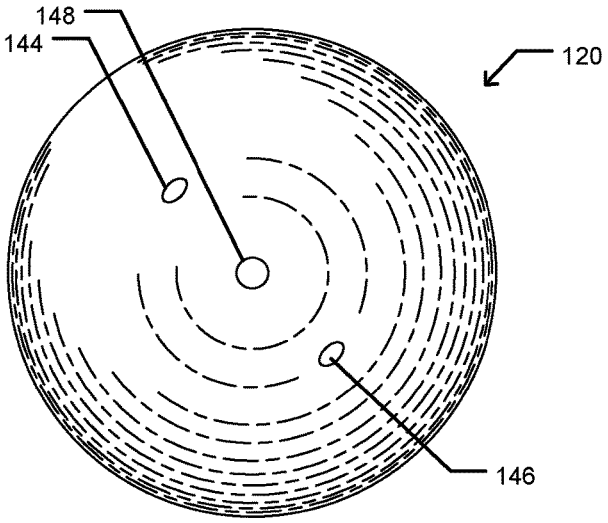
FIG. 3 is a top plan view of the ovoid card container of FIG. 1 according to one embodiment.
Figure 4:
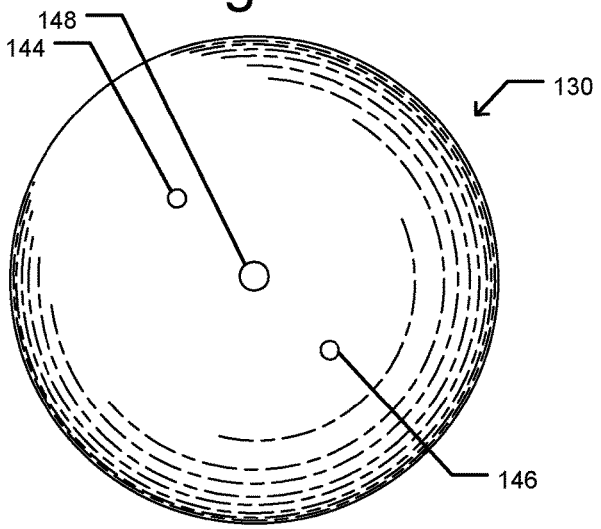
FIG. 4 is a bottom plan view of the ovoid card container of FIG. 1 according to one embodiment.

A top down plan view of the ovoid container 100 is shown in FIG. 3, while, FIG. 4 depicts a bottom plan view of the container. The broken lines 142 are provided as exemplary contour lines to illustrate the relative curvature for one embodiment of the top portion 120 and the bottom portion 130. The top portion 120 and the bottom portion 130 may include one or more openings 144-146, and recess 148. In one aspect, the openings 144-146 and recess 148 may be formed during the manufacturing process. In another aspect, the openings 144 and 146 are provided to aid in the separation of the portions 120 and 130 once joined.

FIG. 5 is a perspective view of the top portion 120. In one embodiment, the top portion 120 is generally defined by the curved surface or wall 121 of an elliptic paraboloid and defines a hollow interior space 124. FIG. 6 is a perspective view of the bottom portion 130 of the container 100. In one embodiment, the bottom portion 130 is generally defined by the curved surface 131 of another elliptic paraboloid and defines another hollow interior space 134. The curved surfaces 121 and 131 of the top portion 120 and bottom portion 130, respectively, each form relatively thin walls 123 and 133 that define respective circular openings, 126 and 136 respectively. The walls 123 and 133 are thin relative to the height and width of the respective main body portions 120 and 130.

The opening 136 of the bottom portion 130 defines a male coupling arrangement 137 that includes a flange 138A and a lip 138B. The flange 138A has a diameter D1 that is less than the diameter D2 of the wall 133 proximate to the opening 136, while the lip 138B has a diameter D3 that is approximately equal to or greater than the diameter D2. As shown in FIG. 6, the opening 126 of the top portion 120 defines a female coupling arrangement 127 that includes a flange 128A and an annular recess 128B. The flange 128A is contiguous with the wall 123 and has a diameter D4 that is greater than the diameter D5 of the wall 123 proximate to the female coupling arrangement. In one aspect, the diameter D4 is greater due, at least in part, to the curvature of the wall 123 and expanding diameter of the top portion 120 as it progresses toward the opening 126.

The top portion 120 and bottom portion 130 cooperatively engage when fitted to one another to close the container 100 and to form together a hollow, generally ovoid shaped main body 110 as shown in FIGS. 1 through 4. In particular, the lip 138B is received in the annular recess 128B, as the exterior surface of the flange 138A of the bottom portion 130 slidably engages the interior surface of the top portion flange 128A.

The outer surfaces of each portion 120 and 115 and, therefore, the main body 110, may include a distinctive coloration, to render the ovoid card container more noticeable and to increase the perception of value to the observer. For example, the exterior surfaces 122A and 132A of the ovoid container may be a golden color. In one aspect, the exterior surfaces 122A and 132A have a metallic golden color, while in other aspects, the golden surfaces have other finishes, including but not limited to matte, glossy, reflective, or iridescent. Additionally, the exterior surfaces 122A and 132A of the ovoid container 100 may be another color or multiple colors.

FIG. 7 is a front elevation view of an exemplary transaction card 150, such as a gift card, showing typical dimensions for a common transaction card. As shown, a typical transaction card 150 has four corners 152, 154, 156, and 158, a length of approximately 3.375 inches along the longitudinal axis 151, and a width of approximately 2.125 inches along the transverse axis 153. The transaction card 150 is shown, as it would be held in one embodiment of the ovoid container 100. In particular, the longitudinal axis 151 of the card is vertically oriented and the transverse axis 153 of the card is horizontally oriented.

Figure 8:
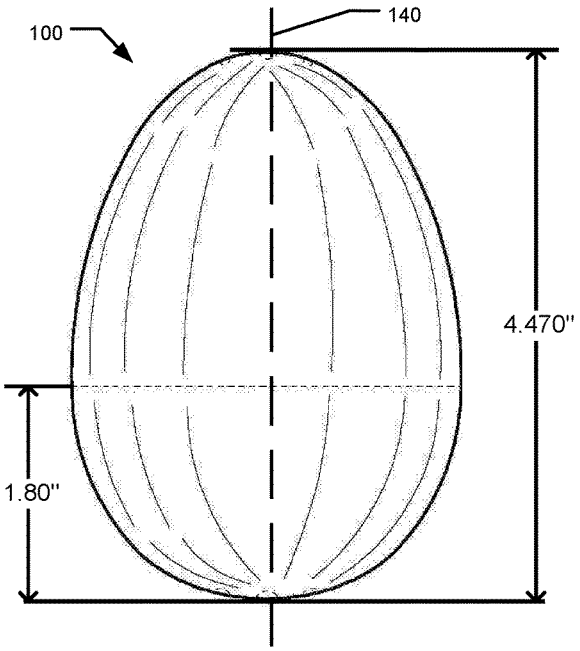
FIG. 8 is an elevation view of an ovoid card container showing exemplary dimensions according to one embodiment.

FIG. 8 is an elevation view of one embodiment of the ovoid card container 100 that also includes exemplary dimensions for the container. In particular, the main body 110 has a length of about 4.470 inches along the longitudinal axis 140, while the bottom portion 130 has a length of approximately 1.8 inches along the longitudinal axis.

Figure 9:
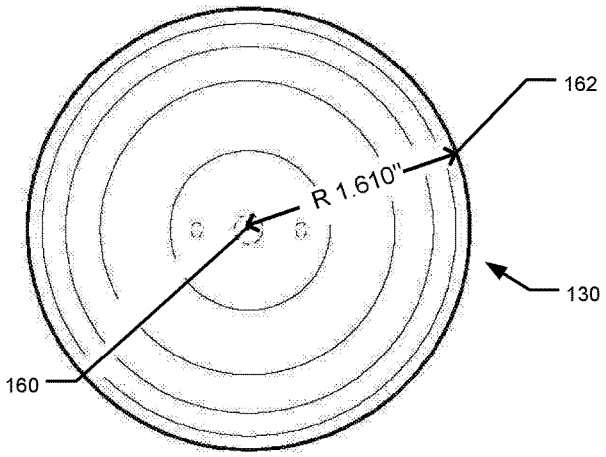
FIG. 9 is a bottom view of an ovoid card container showing exemplary dimensions according to one embodiment.

FIG. 9 is an elevation view of the bottom portion of the ovoid card container 100 as viewed along the longitudinal axis. As shown in one embodiment, the bottom portion 130 has a radius of approximately 1.6 inches radius from the center 160 of the bottom portion that is aligned with the longitudinal axis 140 to the outermost edge 162 of the main body 110. In one aspect, the outer most edge 162 of the main body 110 corresponds to the juncture 164 of the top portion 120 and bottom portion 130, as shown in FIGS. 1-2. The exemplary dimensions of the main body 110, top portion 120 and bottom portion 130, as described herein are provided for embodiments of the ovoid container 100 that preferably hold and retain a transaction card 150 of typical dimensions with no gap or with a minimal gap or clearance between the corners 152, 154, 156, 158 of the card 150 and the interior surfaces 122B and 132B of the top portion 120 and the bottom portion, respectively.

FIG. 10 is a perspective view of an ovoid card container 100 showing the top portion 120 separated from the bottom portion 130 to reveal a transaction card 150 disposed within the main body 110 of the container 100. The transaction card 150 contacts the interior surface of the bottom portion 130. As shown, the top portion 120 is positioned above the card 150 and bottom portion 130, and aligned for engaging the top portion 120 with the bottom portion 130.

FIGS. 11A and 11B are illustrations of an embodiment of the ovoid container 100 when closed and containing a transaction card 150 therein. Similarly, FIG. 12 is a cross-sectional view of the ovoid container 100, viewed along cross-sectional line A-A, as shown in FIG. 11B. In one embodiment, the transaction card 150, when disposed within the ovoid card container 100, may maintain a minimal gap 166 between one or more of the corners 152 and 154, of the card 150 and the interior surface 122B of the top portion 120. When resting within the main body 110, the card 150 is in contact with the interior surface 132B of the bottom portion 130 at one or more corners, such as the corner 156 and the corner 158, when in an upright orientation. As such, the ovoid container 100 may hold the transaction card 150 in a static position securely and prevent the transaction card from excessive motion or jostling that may damage the card. In various other embodiments, the interior surfaces 122B and 132B of the respective top portion 120 and bottom portion 130, or both portions, includes one or more projections, set-offs, or tabs 135 that may engage the transaction card 150.

In various embodiments, the transaction card 150 is automatically oriented into the vertical position, shown in FIGS. 11A, 11B, and 12, when the top portion 120 is engaged to the bottom portion 130. In particular, as one or more of the transaction card corners 152 and 155 engage the interior surface 122B of the top portion 120, the corners slide along the interior surface as the transaction card pivots about one or more of the lower corners 156 and 158, or a line formed by the lower corners, until the transaction card assumes the vertical position relative to the ovoid container 100 as shown.

Figure 24:
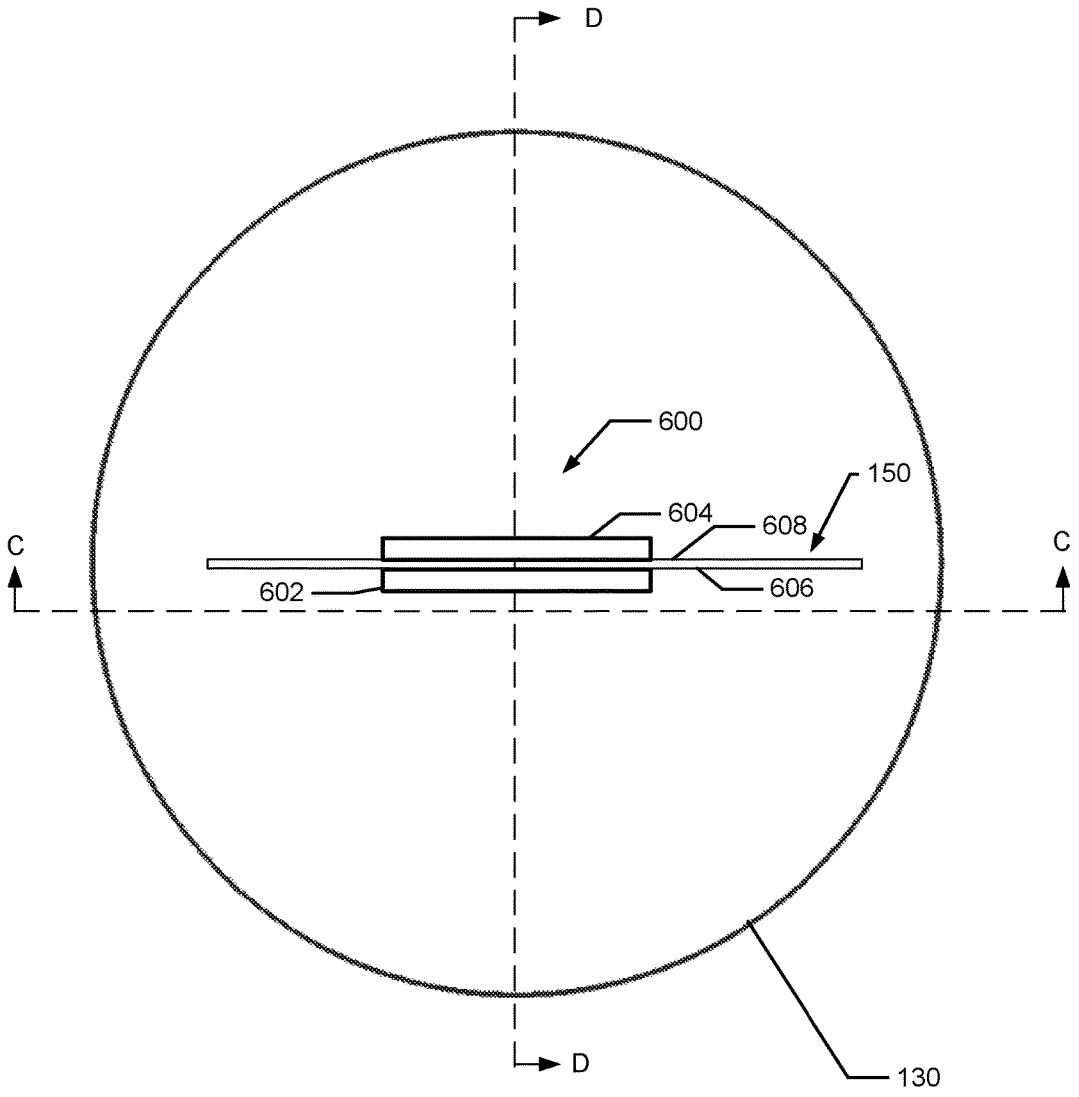
FIG. 24 is a top-down view of the ovoid card container and transaction card of FIG. 23.
Figure 25:
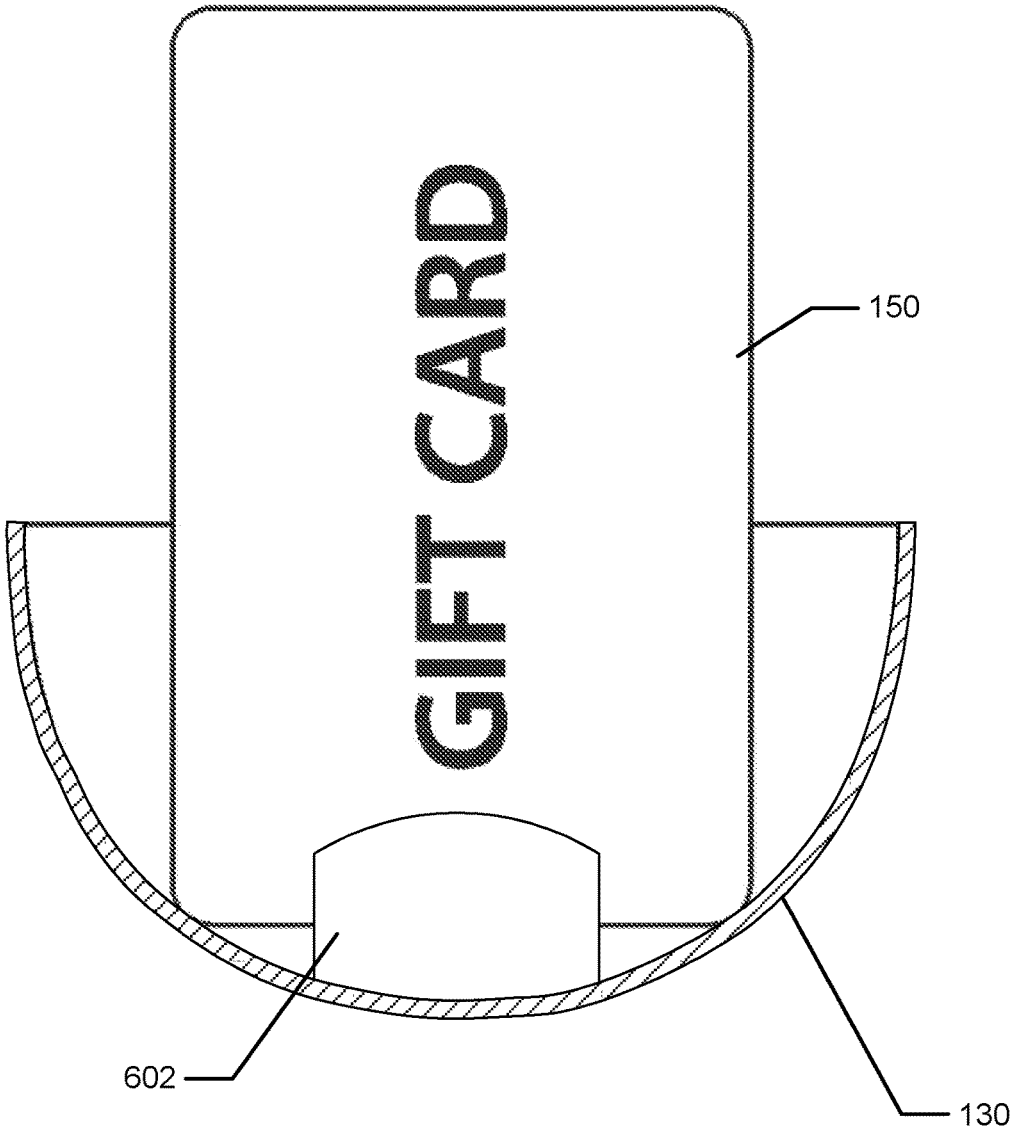
FIG. 25 is a cross-sectional view of an ovoid card container as seen along line C-C of FIG. 24.
Figure 26:
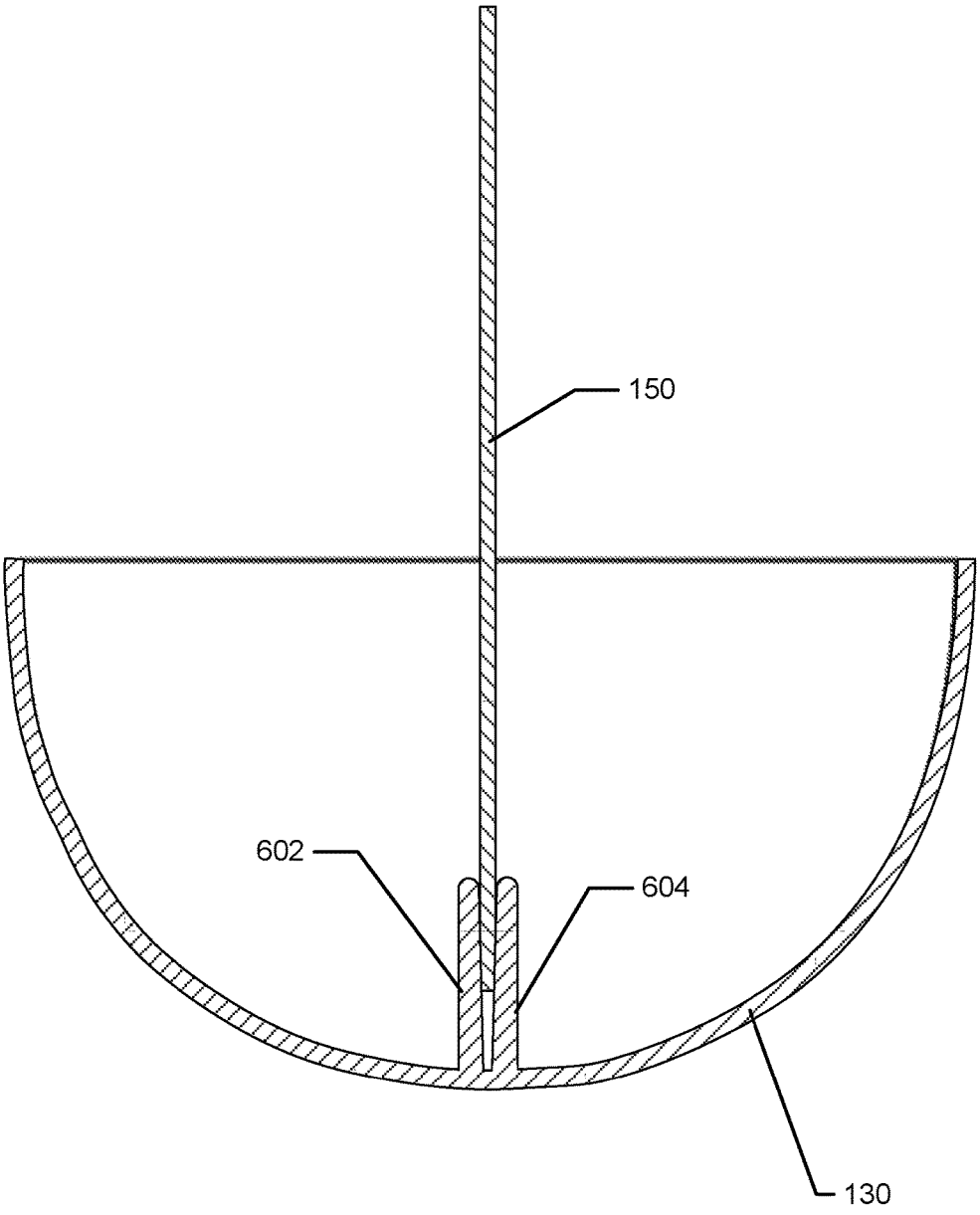
FIG. 26 is a cross-sectional view of an ovoid card container as seen along line D-D of FIG. 24.

FIGS. 22-26 illustrate yet another embodiment of the ovoid container 100. As shown, the ovoid contain 100 may retain a transaction card 150 in a vertical orientation. The transaction card is contacted within the bottom portion 130 of the container 100 by at least one and preferably two or more retention tabs 602 and 604 integral with or otherwise engaged to the interior surface 132B of the bottom portion, shown in FIG. 6. In one embodiment, as shown in FIGS. 24-26, the retention tabs 602 and 604 are attached to the bottom potion 130 and project upward into the interior of the container 100. FIG. 25 is a partial cross-sectional view of one embodiment of the ovoid container 100 of FIG. 24 as viewed along line C-C. Similarly, FIG. 26 is a cross-sectional view of one embodiment of the ovoid container 100 of FIG. 24 as viewed along line D-D. As shown, the retention tabs 602 and 604 engage opposing faces 606 and 608 of the transaction card 150. In embodiments having a single retention tab 602, the retention tab contacts a single face 606 or 608 of the transaction card 150, while the interior surface 122B of the top portion, shown in FIG. 5, contacts the card at the opposite end to maintain the vertical orientation.

In one embodiment, the retention tabs 602 and 604 may be spaced apart to loosely engage the transaction card 150. In another embodiment, the retention tabs 602 and 604 are resilient and the distance between the tabs is less than or equal to the thickness of the transaction card 150, such that the transaction card is retained in a friction fit or, alternatively, a compressive-fit engagement between the retention tabs, as shown in FIG. 26. While the retention tabs 602 and 604 are shown having a width less than the width of the transaction card as measured along the transverse axis 153 shown in FIG. 7, in other embodiments, the retention tabs may extend the full width of the transaction card 150 or beyond. For example, the retention tabs may span the full diameter of the bottom portion 130. Additionally, the retention tabs 602 and 604 may extend from the interior surface 132B of the bottom portion 130, a lessor distance or alternatively, a greater distance than shown.

In various embodiments, one or more complementary upper retention tabs (not shown) may be formed within the top portion 120 to engage the opposite end of the transaction card when the top portion is mated with the bottom portion. In one example, a retention tab, such as tab 602 in the bottom portion 130, and a single upper retention tab (not shown) may contact the opposite faces of the transaction card.

The ovoid container 100 may be displayed and sold at retail locations individually or in conjunction with one or more transaction cards. FIGS. 13 and 14 are illustrations of an ovoid card container 100 disposed within a packaging unit 200. In one embodiment, the packaging unit 200 is a sealable container, such as a cardboard or cardstock box, among others, that includes a one or more transparent viewing windows 202. The transparent window 202 is defined by an aperture in a front panel 204 of the container and a transparent or at least translucent material, including but not limited to a transparent polymer sheet or film. In this embodiment, the transaction card 150 is removably mounted on a header portion 206 extending upward from a packaging container portion 208 of the packaging unit 200. Once purchased, the ovoid card container 100 is removed from the packaging unit 200 and the transaction card 150 is removed from the header portion 206 for placement therein. For example, the ovoid container 100 is opened by separating the top portion 120 from the bottom portion 130 and at least a portion of the transaction card 150 is placed inside the bottom portion 130. The ovoid container is closed by placing the top portion 120 over the bottom portion 130 and engaging the two portions. As previously described, the transaction card 150 may be automatically aligned in a vertical position as the two body portions 120 and 130 are brought together. Once the ovoid container 100 is closed with the transaction card 150 placed therein, the ovoid container may be given to a gift recipient or more typically, used as a prize to be coveted in an Easter egg hunt or a scavenger hunt.

Figure 15:
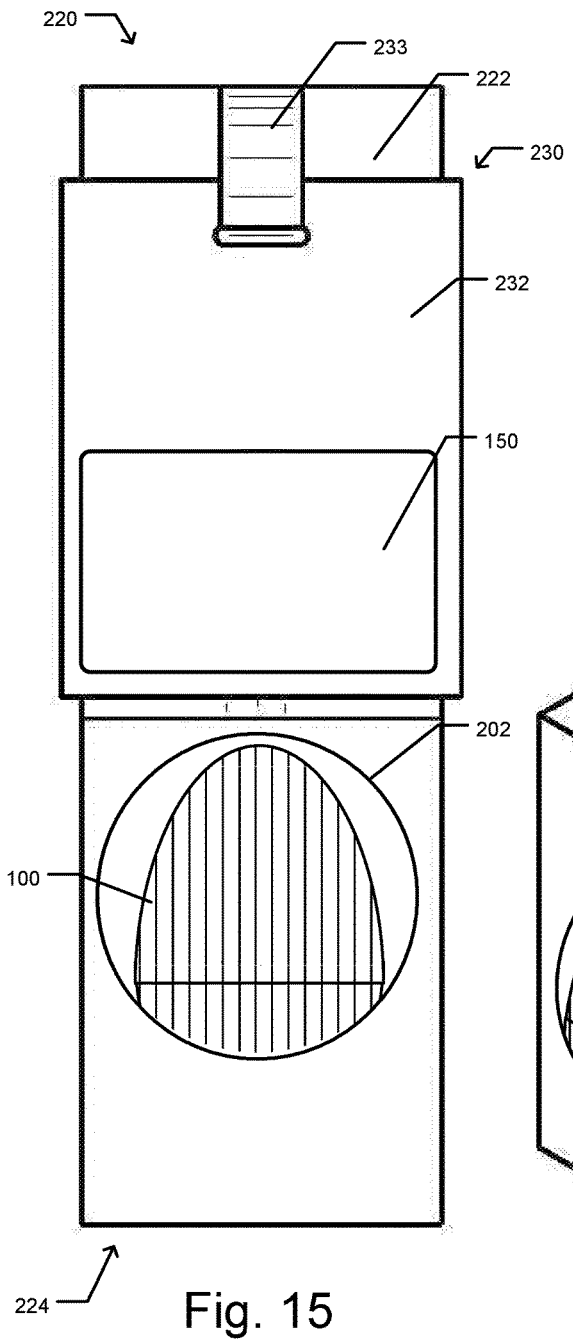
FIG. 15 is elevation view of an ovoid card container disposed within packaging having an upwardly extended header portion and a transaction card mounted on a backer panel attached to the header portion according to one embodiment.
Figure 16:
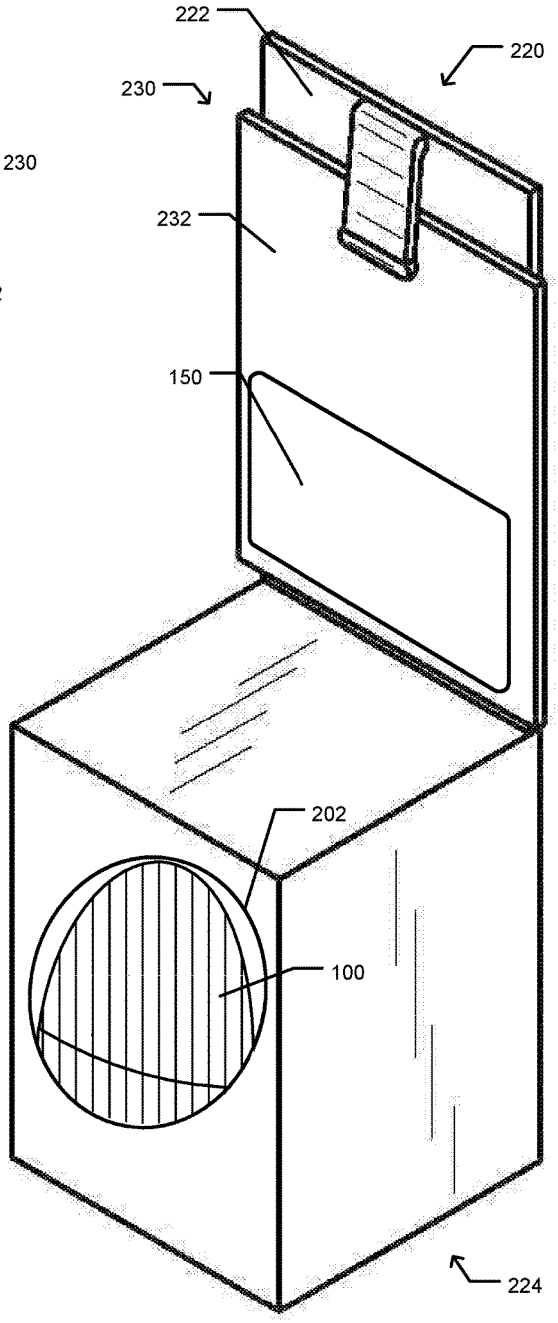
FIG. 16 is a perspective view of the ovoid card container and packaging of FIG. 15 according to one embodiment.

FIGS. 15 and 16 depict another embodiment of a retail packaging unit 220 for displaying and selling the ovoid container. As shown the packaging unit 220 includes elongated header portion 222 that extends away from a packaging container portion 224 of the unit. The header portion 222 is engaged to a transaction card assembly 230 that includes transaction card 150 mounted on a backer panel 232. In one embodiment, the transaction card assembly 230 may include one or more transaction cards engaged to a backer panel that is typically configured for sale independent of the ovoid container. By way of example, the backer panel 206 and the mounted transaction card may be affixed to the header portion 222 at the retail location. For example, the transaction card assembly 230 may be attached to the elongated header portion 222 via a tab, loop of material 233, or any other suitable mechanism. As such, the retail packaging unit 220 and the transaction card assembly 230 may be prepared by separate vendors. In another example, the transaction card assembly and the retail packaging unit 150 may be assembled before distribution to retail locations.

Figure 17:
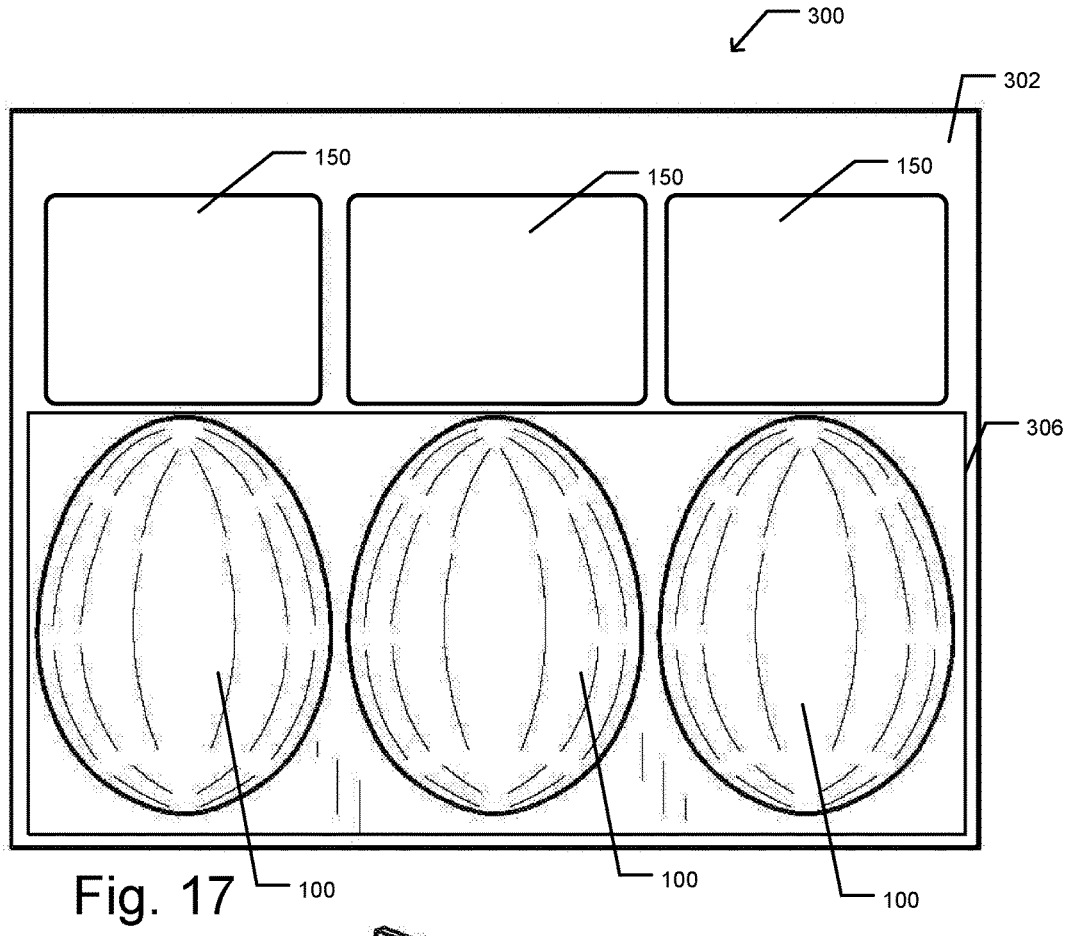
FIG. 17 is an elevation view of a bubble pack holding a plurality of ovoid card containers each paired with a transaction card according to one embodiment.
Figure 18:
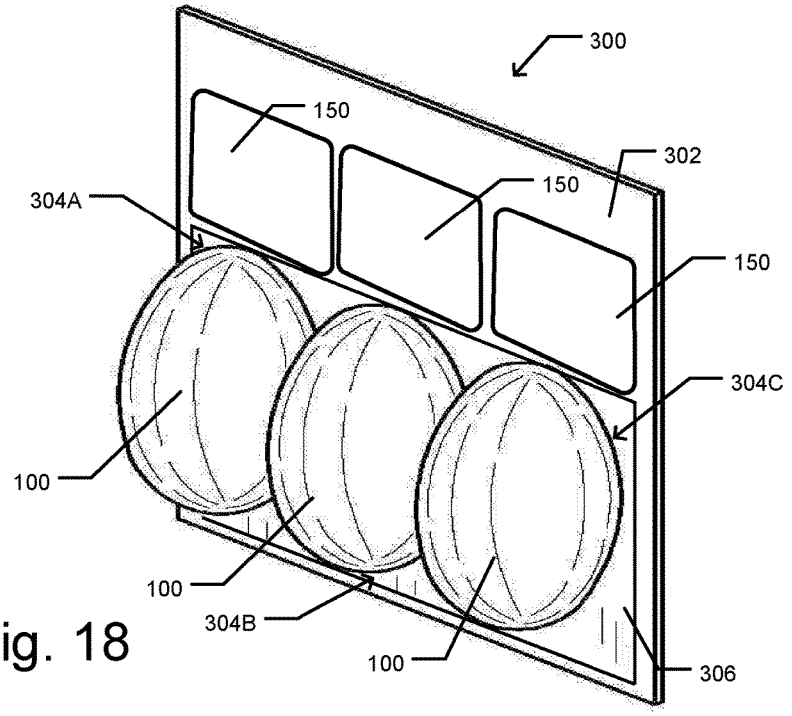
FIG. 18 is a perspective view of the ovoid card container and packaging of FIG. 17 according to one embodiment.
Figure 22:
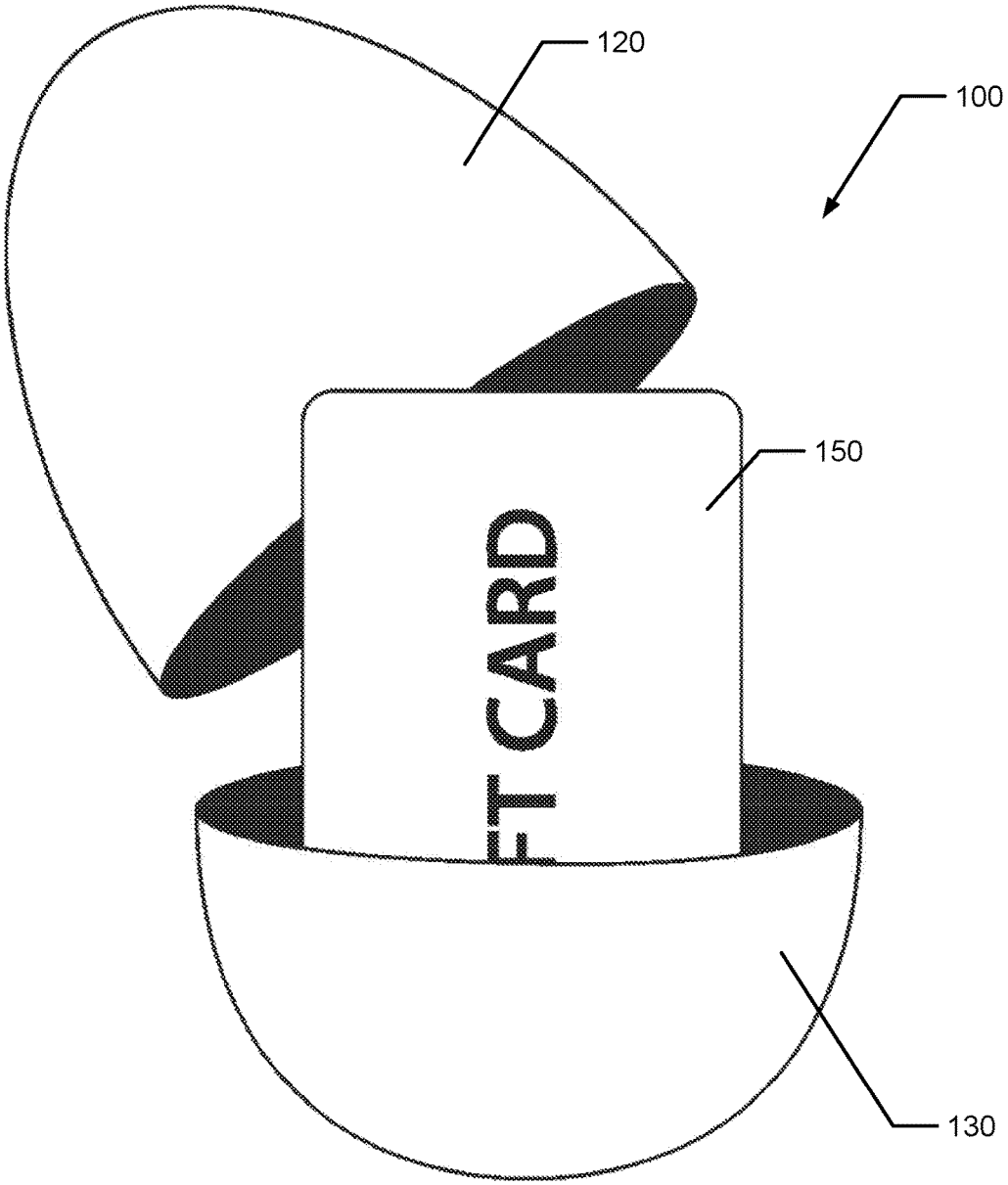
FIG. 22 is a perspective view of an ovoid card container containing a transaction card according to one embodiment.
Figure 23:
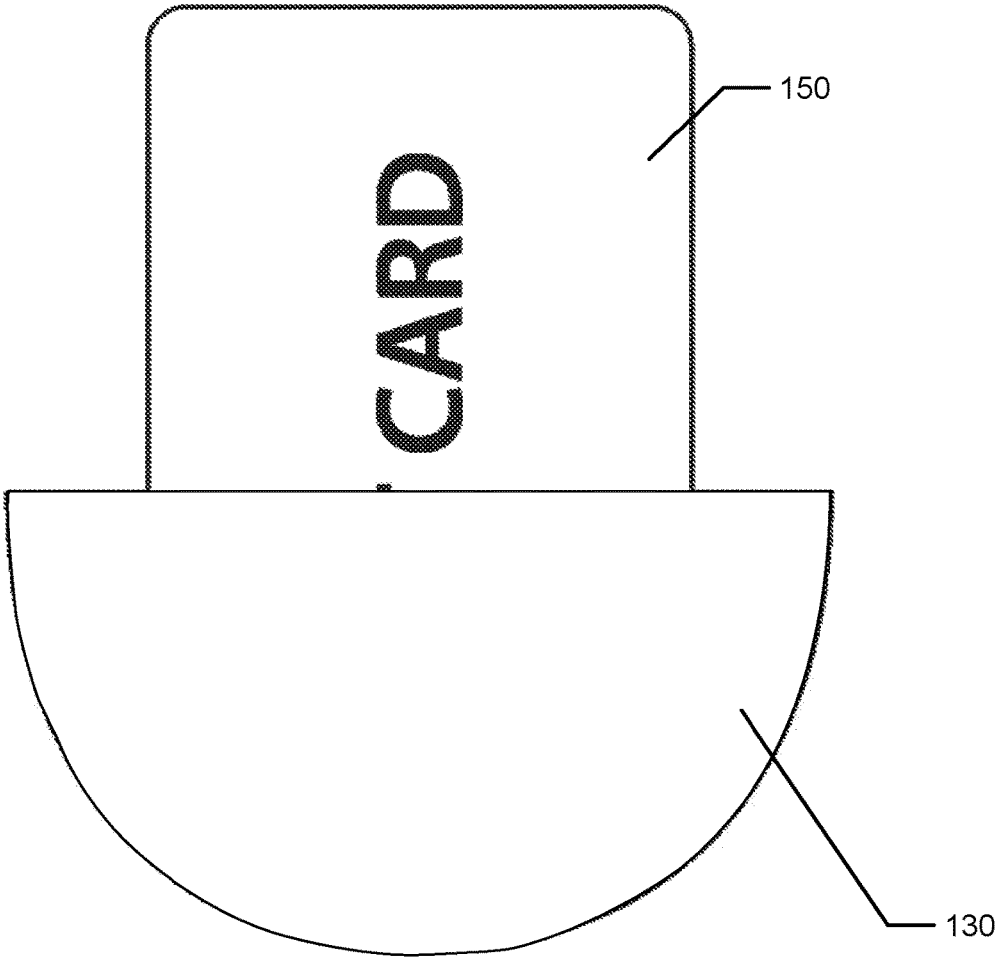
FIG. 23 is an elevation view of a transaction card positioned within the bottom portion of an ovoid card container.

FIGS. 17 and 18 depict another embodiment of a retail packaging unit 300 for holding multiple ovoid card containers 100 and a corresponding number of transaction cards 150. In one aspect, the retail packaging unit 300 includes a main panel portion 302 that defines openings 304 A-C for receiving the ovoid containers 100. The ovoid containers may be retained by any suitable mechanism including but not limited to a clear polymer-based clamshell arrangement 306 that is further engaged to or between portions of the main panel 302. In another embodiment, the ovoid containers are secured to the main backer panel within a clear polymer-based bag ("polybag") that envelops the entire retail packaging unit 300.

A number of transaction cards 150 that correspond to the number of ovoid containers 100 are removably mounted to the main panel portion. In one embodiment, the transaction cards 150 are mounted to the main backer panel via a removable adhesive.

FIGS. 19-20 depict embodiments of other retail package units for various embodiments of the ovoid container 100. In particular, FIG. 19 is a perspective view of a of an ovoid card container 100 disposed within a packaging unit 400 similar to the packaging container portion 208 as shown un FIGS. 13-16. The packaging unit 400 as depicted is used for the display and sale of the ovoid card container 100 without a transaction card. Similarly, FIG. 20 is a front elevation view of an ovoid card container 100 disposed within a packaging unit 500 comprising a clear polybag 502. The container 100 is fully disposed and held within the polybag 502. In one embodiment, the upper, initially open end 510 of the polybag 502 is secured and held closed by a cardstock header 504 having a front flap 506 hingedly connected to a back flap 508, as shown in FIG. 21. The header 504 receives the end 510 of the bag 502 between the front flap 506 and back flap and the header folded upon one another with the upper end of the polybag 502 disposed and enclosed there between. The front flap 506 and back flap 508 are then stapled or otherwise secured to one another to hold the flaps together in a closed position and retain the polybag 502 between the flaps so that the polybag 502 may be hung upon a display rack (not shown) by an aperture 512 (e.g. sombrero-cut hole) in the header 504. In another embodiment, the end 510 of the polybag 502 may be stapled, adhered, or otherwise attached and sealed to a header panel 504 of unitary constriction.

Specific design features of the apparatus and methods disclosed herein were developed to meet a strong but unmet demand by consumers for a distinctive "Easter egg" type of container 100 sized to securely and closely hold a gift card 150 so that the interior walls of the container 100 contact or nearly contact all four corners of the gift card to avoid excessive movement or rattling of the gift card 150 within the container 100. To assure distinctiveness of the container 100 relative to conventional plastic eggs in the prior art, it is preferred that the container 100 be formed of or coated with a highly distinctive color, and preferred that such color be associated in the mind of the consumer with high value, and further preferred that such color be a metallic gold as such coloration meets the stated preferred criteria.

It should be appreciated that the main body 110 may be constructed of various types of plastics or of other resilient materials and may bear various graphics and designs while maintaining the general structure and functionality described herein. Certain embodiments of the container 100 and any associated packaging are constructed and assembled to comply with standard space constraints for display upon store racks, and more particularly to not exceed 5.25 inches tall by 4 inches wide.

It is believed that the present disclosure and many of its attendant advantages will be understood by the foregoing description, and it will be apparent that various changes may be made in the form, construction, and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Those skilled in the art will appreciate that variations from the specific embodiments disclosed above are contemplated by the invention. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. A system for holding a transaction card, the transaction card being substantially rectangular, having a first end edge, a second end edge, opposing lateral edges, a front face, a back face, a length, a width, and four corners, the system comprising:

a first portion and a second portion, the first portion being removably securable relative to the second portion such that the first and second portions can be separated, or put together to form a fully-engaged container, the fully-engaged container establishing a substantially ovoid exterior surface, and a substantially ovoid internal surface, the external and internal surfaces being substantially symmetrical about a central longitudinal axis;

when separated, the first and second portions being configured to accept the transaction card, and when fully engaged, the internal surfaces are configured to cause the transaction card to move into a substantially static position and be held inside the system such that:

(i) each corner of the card engages or forms a minimal gap with the internal surface;

(ii) the card is substantially centered along, and substantially in line with the central longitudinal axis;

(iii) the lateral edges of the card are substantially parallel with the center longitudinal axis; and (iv) the first and second end edges are substantially perpendicular relative to the center longitudinal axis;

a first pair of opposing retaining tabs protruding from the internal surface of the first portion, the first pair of opposing retaining tabs adapted to bear against the front and back faces at a first end of the card when the card is received in between the first pair of opposing retaining tabs; and a second pair of opposing retaining tabs protruding from the internal surface of the second portion, the second pair of opposing retaining tabs adapted to bear against the front and back faces at a second end of the card when the card is received in between the second pair of opposing retaining tabs;

the first and second pairs of opposing retaining tabs assisting in aligning the card along the central longitudinal axis and statically holding the card when the card is received in the container.

2. The system of claim 1 wherein the card is about 3.375 inches long and about 2.125 inches wide.

3. The system of claim 1 wherein the card that the system is adapted to accommodate has rounded corners, and the internal surfaces are configured to accommodate the rounded corners.

4. The system of claim 1 wherein the first and second pairs of opposing retaining tabs are resilient.

5. The system of claim 1 wherein the internal surfaces of the first and second portions are configured to position the card such that a transverse center axis of the card is offset from and substantially parallel with a juncture plane made where the first portion joins the second portion.

6. A packaging system for a transaction card, the transaction card being substantially rectangular and having a length and a width, a front face and a back face, and four corners, the system comprising:

a package including a mounting area for the transaction card and a receiving area for a container for the transaction card;

the container being separable into first and second portions, the first portion being removably securable relative to the second portion such that the first and second portions can be separated, or put together to form a fully-engaged container, the fully-engaged container having a substantially ovoid exterior surface, and a substantially ovoid internal surface, the external and internal surfaces being substantially symmetrical about a central longitudinal axis;

when separated, the first and second portions being configured to accept the transaction card, and when fully engaged, the internal surfaces are configured to cause the transaction card to be substantially statically held inside the system such that the card is substantially centered along, and substantially in line with the central longitudinal axis when contained in the system;

a first pair of opposing retaining tabs protruding from the internal surface of the first portion, the first pair of opposing retaining tabs adapted to bear against the front and back faces at a first end of the card when the card is received in between the first pair of opposing retaining tabs; and a second pair of opposing retaining tabs protruding from the internal surface of the second portion, the second pair of opposing retaining tabs adapted to bear against the front and back faces at a second end of the card when the card is received in between the second pair of opposing retaining tabs;

the first and second pair of opposing retaining tabs assisting in aligning the card along the central longitudinal axis and statically holding the card when the card is received in the container.

7. The packaging system of claim 6 wherein the interior surfaces are configured such that each corner of the transaction card one of: (i) contacts; or (ii) forms a minimal gap with the inside surface.

8. The system of claim 6 wherein the card is about 3.375 inches long and about 2.125 inches wide.

9. A system for holding a transaction card, the transaction card being substantially rectangular and having a length and a width, a front face and a back face, and four corners, the system comprising:

a container being separable into first and second portions, the first portion being removably securable relative to the second portion such that the first and second portions can be separated, or combined to form a fully-engaged container, the fully-engaged container having a substantially ovoid exterior surface, and a substantially ovoid internal surface, the external and internal surfaces being substantially symmetrical about a central longitudinal axis;

when separated, the first and second portions being configured to accept the transaction card, and when fully engaged, the internal surfaces are configured to cause the transaction card to be substantially held inside the system such that the card is substantially centered along, and substantially in line with the central longitudinal axis when contained in the system;

at least one of the first and second portions including a first pair of opposing retaining tabs, the first pair of opposing retaining tabs adapted to bear against the front and back faces of the card when the card is received in between the first pair of opposing retaining tabs in the container, the first pair of retaining tabs assisting in aligning the card along the central longitudinal axis and securing the card against movement when the first and second portions are fully engaged; and a second pair of retaining tabs protruding from the internal surface of the other of the first and second portions, the second pair of retaining tabs adapted to bear against the front and back faces at a different card position than that received by the first pair of opposing retaining tabs;

the first and second pair of tabs together assisting in aligning the card along the central longitudinal axis and statically holding the card when the card is received in the container.

* * * * *